US006794349B2

(12) United States Patent
Hafkamp et al.

(10) Patent No.: US 6,794,349 B2
(45) Date of Patent: Sep. 21, 2004

(54) DETERGENT COMPOSITIONS

(75) Inventors: Rudolfus Johannes Hafkamp, Vlaardingen (NL); Rob Menting, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/268,248

(22) Filed: Oct. 10, 2002

(65) Prior Publication Data

US 2003/0078183 A1 Apr. 24, 2003

(30) Foreign Application Priority Data

Oct. 10, 2001 (GB) ..... 0124308

(51) Int. Cl.[7] ..... C11D 1/72; C11D 1/83; C11D 3/37; D06L 1/00

(52) U.S. Cl. ..... 510/356; 510/351; 510/357; 510/360; 510/445; 510/475; 510/492; 510/531; 510/535; 8/137

(58) Field of Search ..... 510/351, 356, 510/357, 360, 445, 475, 492, 531, 535; 8/137

(56) References Cited

U.S. PATENT DOCUMENTS

| | | | | |
|---|---|---|---|---|
| 3,983,078 | A | 9/1976 | Collins | 252/540 |
| 4,954,292 | A | 9/1990 | Hull et al. | 252/542 |
| 5,900,396 | A | 5/1999 | Cala et al. | 510/351 |
| 6,494,920 | B1 | 12/2002 | Weuthen et al. | |
| 2002/0137656 | A1 * | 9/2002 | Blything et al. | 510/421 |
| 2002/0160929 | A1 * | 10/2002 | Singh et al. | 510/426 |
| 2003/0073603 | A1 * | 4/2003 | Hafkamp et al. | 510/421 |
| 2003/0078183 | A1 * | 4/2003 | Hafkamp et al. | 510/421 |

FOREIGN PATENT DOCUMENTS

| | | | |
|---|---|---|---|
| DE | 4313949 | * 11/1994 | |
| DE | 43 20 851 | 1/1995 | |
| EP | 164 072 | 12/1985 | |
| EP | 287 343 | 10/1988 | |
| EP | 0 293 139 | 11/1988 | |
| EP | 0 299 575 | 1/1989 | |
| EP | 0 313 146 | 4/1989 | |
| EP | 0 383 828 | 8/1990 | |
| EP | 0 495 258 | 7/1992 | |
| EP | 0 582 478 | 2/1994 | |
| EP | 0 753 567 | 1/1997 | |
| GB | 2 020 688 | 11/1979 | |
| WO | 93/02176 | 2/1993 | |
| WO | 94/16052 | 7/1994 | |
| WO | WO 94/16052 | * 7/1994 | ..... C11D/17/06 |
| WO | 00/08129 | 2/2000 | |
| WO | 00/45788 | 8/2000 | |
| WO | 02/50223 | 6/2002 | |

OTHER PUBLICATIONS

PCT International Search Report in a PCT application PCT/GB 02/04122, dated Jan. 15, 2003.
Derwent Abstract of DE 43 20 851—published Jan. 5, 1995.
PCT International Search Report in a PCT/GB application: PCT/GB 02/04154 dated Dec. 10, 2002.
Derwent Abstract of DE 43 13 949 published Nov. 3, 1994.
Derwent Abstract of EP 164 072 published Dec. 11, 1985.
Co–pending application: Applicant: Hafkamp et al., Ser. No.: 10/268,248; Filed: Oct. 20, 2002.
Co–pending application: Applicant: Blything et al., Ser. No.: 10/013,790; Filed: Dec. 11, 2001.
Co–pending application: Applicant: Singh et al., Ser. No.: 10/013,754; Fl;ed: Dec. 11, 2001.
GB Search Report in a GB application GB 0 124308.8 dated Mar. 25, 2002.
PCT International Search Report in a PCT application PCT/EP 03/12416.
Japanese Derwent Abstract JP 61 275207—published Dec. 5, 1986.
Japanese Derwent Abstract JP 59 015497—published Jan. 26, 1984.
Derwent Abstract SU 1 707 058—published Jan. 23, 1992.

* cited by examiner

*Primary Examiner*—Brian P. Mruk
(74) *Attorney, Agent, or Firm*—Rimma Mitelman

(57) ABSTRACT

A built particulate laundry detergent composition containing anionic sulphonate or sulphate surfactant and conventional ethoxylated alcohol nonionic surfactant also contains a low level of a highly ethoxylated alcohol nonionic surfactant having an average degree of ethoxylation of from 15 to 40. The composition exhibits increased mildness to the skin without loss of detergency performance.

12 Claims, No Drawings

DETERGENT COMPOSITIONS

TECHNICAL FIELD

The present invention relates to built laundry detergent compositions containing anionic sulphonate or sulphate surfactants and exhibiting increased mildness to the skin.

BACKGROUND

Heavy duty laundry detergent compositions have for many years contained an anionic sulphonate or sulphate surfactant, for example, linear alkylbenzene sulphonate (LAS) or primary alcohol sulphate (PAS), as the principal detergent-active ingredient. These anionic surfactants are frequently used in conjunction with ethoxylated alcohol nonionic surfactants which give improved detergency on hydrophobic soils. The nonionic surfactants generally have alkyl chain lengths of $C_{12}$–$C_{18}$ and degrees of ethoxylation of 1 to 10.

These anionic and anionic/nonionic surfactant systems are robust and highly efficient on a wide range of soils and under a wide range of conditions, for example, temperature and water hardness. However, they are not noted for mildness to skin. These materials are designed to interact with fatty materials like body soil and protein residues on soiled laundry, and can therefore interact with the skin to give reactions such as dryness and erythema (redness). The milder surfactants used to formulate products intended for prolonged skin contact, for example, shampoos and shower gels, would not perform adequately in heavy duty laundry detergent compositions because of insufficient interaction with fatty materials occurring as soil.

It has now been surprisingly discovered that the mildness to skin of a laundry detergent composition containing an anionic sulphonate or sulphate detergent and a conventional detergent ethoxylated nonionic surfactant can be significantly improved, without detriment to detergency performance, by the incorporation of a low level of a much more highly ethoxylated nonionic surfactant.

PRIOR ART

GB 2 020 688 (Unilever) discloses a high suds washing powder comprising an active blend of an anionic surfactant and a nonionic surfactant. Only one type of nonionic surfactant in combination with anionic surfactant is disclosed.

U.S. Pat. No. 4,954,292 (Lever Brothers) discloses a detergent composition which comprises anionic surfactant, PVP and a blend of nonionic surfactants. An example is given which discloses, inter alia, Synperonic A3 and A7 together.

WO 94 16052A (Unilever) discloses high bulk density particulate laundry detergent compositions containing low levels (typically below 1 wt %) of a highly ethoxylated long chain alcohol, for example tallow alcohol 80EO, the benefit being improved dissolution.

EP 293 139A (Procter & Gamble) discloses detergent compositions enclosed in two-compartment sachets, the compositions exemplified containing low levels (0.2–0.8 wt %) of tallow alcohol 25EO.

WO 93 02176A (Henkel) discloses the use of highly ethoxylated aliphatic alcohols as "structure breakers" in high bulk density laundry detergent powders containing conventional ethoxylated alcohol nonionic surfactants.

WO 00 08129A (Unilever) discloses mild particulate laundry detergent compositions based on high-foaming anionic surfactant (for example linear alkylbenzene sulphonate) plus one or more milder cosurfactants, for example, amine oxide or cocoamidopropyl betaine.

DEFINITION OF THE INVENTION

The present invention provides a built particulate laundry detergent composition comprising (i) from 5 to 25 wt % of an anionic sulphonate or sulphate surfactant, (ii) from 1 to 10 wt % of an ethoxylated alcohol nonionic surfactant having an alkyl chain length of from $C_8$ to $C_{18}$ and an average degree of ethoxylation of from 3 to 10, (iii) from 1 to 5 wt % of a highly ethoxylated alcohol nonionic surfactant having an average degree of ethoxylation of from 15 to 40, (iv) from 10 to 80 wt % of detergency builder and (v) optionally other detergent ingredients to 100 wt %.

The present invention further provides the use of an ethoxylated alcohol nonionic surfactant having an average degree of ethoxylation of from 15 to 40, in an amount of from 1 to 5 wt %, to increase the mildness to skin of a built particulate laundry detergent composition containing an anionic sulphonate or sulphate detergent.

DETAILED DESCRIPTION OF THE INVENTION

Detergent compositions of the invention contain a conventional anionic sulphonate or sulphate surfactant and a conventional nonionic surfactant, and also contain as an essential ingredient a low level of a highly ethoxylated nonionic surfactant (iii) which is an aliphatic alcohol having an average degree of ethoxylation of from 15 to 40.

The invention is based on the observation that use of a highly ethoxylated nonionic surfactant at low levels to supplement or replace part of a conventional anionic/nonionic surfactant system results in a measurable increase in mildness to skin.

It is well known and intuitively obvious that the mildness to skin of a formulation can be increased simply by reducing the amount of surfactant. However, cleaning efficiency is then reduced. Surprisingly, it has now been found that addition of low levels of highly ethoxylated nonionic surfactant will increase mildness even when the total surfactant level is kept constant, i.e. the high ethoxylate replaces a small proportion of the other surfactants. For example, in a formulation containing 15 wt % surfactant (LAS and ethoxylated nonionic) replacement of as little as 5 wt % of that surfactant is beneficial with respect to mildness, and there is no loss of cleaning efficiency. It is surprising that such a small addition has a significant effect. The effect on mildness is significantly greater than that of an equal amount of alkyl ether sulphate or cocoamidopropyl betaine, both of which are known from the prior art as supplements to increase mildness.

According to an especially preferred embodiment of the invention, the skin-mild detergent compositions of the invention are free of enzymes, since enzymes can also cause skin irritation to sensitive individuals. However, enzymatic compositions are also within the scope of the invention.

The Anionic Sulphonate or Sulphate Surfactant (i)

Anionic sulphonate and sulphate surfactants are well-known to those skilled in the art. Many suitable detergent-active compounds are available and are fully described in the literature, for example, in "Surface-Active Agents and Detergents", Volumes I and II, by Schwartz, Perry and Berch.

Examples include alkylbenzene sulphonates, primary and secondary alkylsulphates, particularly $C_8$–$C_{15}$ primaryalkyl sulphates; alkyl ether sulphates; olefin sulphonates; alkyl xylene sulphonates; dialkyl sulphosuccinates; and fatty acid ester sulphonates. Sodium salts are generally preferred.

Preferably the anionic surfactant is linear alkylbenzene sulphonate or primary alcohol sulphate. More preferably the anionic surfactant is linear alkylbenzene sulphonate.

The Nonionic Surfactant (ii)

Conventional nonionic detergent surfactants are ethoxylated alcohols of the formula $$R_1—(—O—CH_2—CH_2)_m—OH$$

wherein $R_1$ is a $C_8$–$C_{20}$ hydrocarbyl chain, and the average degree of ethoxylation m is generally from 1 to 10, preferably from 3 to 8. The alkyl chain length is preferably in the $C_{12}$ to $C_{15}$ range.

The Highly Ethoxylated Nonionic Surfactant (iii)

The highly ethoxylated nonionic surfactant is an ethoxylated aliphatic alcohol of the formula $$R_2—(—O—CH_2—CH_2)_n—OH$$

wherein $R_2$ is a hydrocarbyl chain and the average degree of ethoxylation n is from 15 to 40, preferably from 16 to 35, more preferably from 18 to 32, most preferably from 20 to 30. The average degree of ethoxylation may even be from 22 to 30.

The alkyl chain length may range, for example, from $C_{12}$ to $C_{20}$. In commercial materials containing a spread of chain lengths, these figures represent an average. The alcohol may be derived from natural or synthetic feedstock.

Desirably, the highly ethoxylated alcohol nonionic surfactant is a solid at ambient temperature, so that it may conveniently be incorporated in the compositions of the invention in the form of separately admixed granules. Because these materials are solid, no carrier material is required in the granules: especially preferred granules are substantially 100 wt % pure and have a particle size within the range of from 100 to 2000 micrometres.

Where the alkyl chain is linear or only lightly branched, the chain length is preferably at least $C_{16}$, more preferably from $C_{16}$ to $C_{18}$. An example of a highly preferred material of this type is Lutensol (Trade Mark) AT25 ex BASF, which has an alkyl chain length of $C_{16}$-$C_{18}$ and an average degree of ethoxylation of 25.

Where the alkyl chain is more highly branched, for example, contains at least three methyl groups, a shorter chain length may be suitable. Another highly preferred material for use in the present invention is Lutensol (Trade Mark) TO20 ex BASF, which has a highly branched $C_{12}$ (average) alkyl chain containing on average from 3 to 4 methyl groups (including a terminal methyl group), and an average degree of ethoxylation of 20.

Both of these materials are waxy solids at ambient temperature and are available in pure granular form suitable for postdosing to detergent powder compositions.

The Detergency Builder

The compositions of the invention also contain from 10 to 80%, preferably from 15 to 70% by weight, of detergency builder. Preferably, the quantity of builder is in the range of from 15 to 50% by weight.

Preferably the builder is selected from zeolite, sodium tripolyphosphate, sodium carbonate, sodium citrate, layered silicate, and combinations of these.

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Ineos Silicas Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Other Detergent Ingredients

As well as the surfactants and builders discussed above, the compositions may optionally contain bleaching components and other active ingredients to enhance performance and properties.

These optional ingredients may include, but are not limited to, any one or more of the following: soap, peroxyacid and persalt bleaches, bleach activators, sequestrants, cellulose ethers and esters, other antiredeposition agents, sodium sulphate, sodium silicate, sodium chloride, calcium chloride, sodium bicarbonate, other inorganic salts, proteases, lipases, cellulases, amylases, other detergent enzymes, fluorescers, photobleaches, polyvinyl pyrrolidone, other dye transfer inhibiting polymers, foam controllers, foam boosters, acrylic and acrylic/maleic polymers, citric acid, soil release polymers, fabric conditioning compounds, coloured speckles, and perfume.

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture.

Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

Although, as previously indicated, in one preferred embodiment of the invention enzymes are preferably absent, in other embodiments detergent enzymes may be present. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Product Form and Preparation

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

Tablets may be prepared by compacting powders, especially "concentrated" powders.

EXAMPLES

The invention is illustrated in further detail by the following non-limiting Examples, in which parts and percentages are by weight unless otherwise stated. Examples according to the invention are designated by numbers, and comparative examples by letters.

Examples 1 to 6, Comparative Examples A to D

Skin Mildness Tests

Skin mildness was determined using the corneosurfametry (CSM) method as described by G Pierard et al, Dermatology 189 (1994) pages 152-156, on pigskin and on human skin.

Model formulation solutions were prepared containing the following ingredients:

| | weight % |
|---|---|
| Total surfactant | 0, 1.0 or 2.0 |
| Zeolite MAP | 0.18 |
| Sodium carbonate | 0.11 |
| Sodium citrate | 0.03 |
| Water | to 100% |

The solutions were buffered to a pH of 10.5 which is typical for wash liquors.

The tables below show the surfactant systems tested and the CSM values of the solutions measured on pigskin and human skin. The higher the CSM value, the milder the formulation. The abbreviations used for the surfactants are as follows:

| | |
|---|---|
| LAS: | sodium linear alkylbenzene sulphonate |
| NI7EO: | nonionic surfactant, $C_{12}$–$C_{15}$ alcohol 7EO. |
| TO20: | nonionic surfactant, highly branched $C_{12}$ alcohol, 20EO. |
| AT25: | nonionic surfactant, $C_{16}$–$C_{18}$ alcohol, 25EO. |

| | Surfactant system | CSM value | |
|---|---|---|---|
| | | Pigskin | Human skin |
| A | Water only | 76.0 | 75.0 |
| | At 1% total surfactant: | | |
| B | LAS only | 17.4 | 5.1 |
| C | LAS/NI7EO, ratio 8:7 | 45.7 | 48.8 |
| 1 | LAS/NI7EO/TO20, ratio 8:7:4 | 57.5 | |
| 2 | LAS/NI7EO/AT25, ratio 8:7:4 | 55.5 | |
| 3 | LAS/NI7EO/AT25, ratio 8:7:2 | | 54.8 |
| | At 2% total surfactant: | | |
| D | LAS/NI7EO, ratio 8:7 | 42.0 | 27.6 |
| 4 | LAS/NI7EO/TO20, ratio 8:7:4 | 49.2 | |
| 5 | LAS/NI7EO/AT25, ratio 8:7:4 | 48.9 | |
| 6 | LAS/NI7EO/AT25, ratio 8:7:2 | | 39.8 |

Examples 7 and 8, Comparative Examples E to N

Comparative Skin Mildness Tests

Using the CSM method on pigskin, the improvement in skin mildness effected by the addition of the highly ethoxylated nonionic surfactant TO20 was compared with the improvements obtained using the same amounts of sodium lauryl ether sulphate (SLES) and cocooamidopropyl betaine (CAPB). The results are shown in the table below.

| | Surfactant system | Total surfactant | CSM value |
|---|---|---|---|
| E | Water | 0 | 74.1 |
| F | LAS | 1 | 14.4 |
| G | LAS/NI7EO, 8:7 | 1 | 41.8 |
| H | LAS/NI7EO, 8:7 | 0.7 | 49.1 |
| 7 | LAS/NI7EO/TO20, 1.3:1:1.15 | 1 | 63.0 |
| J | LAS/NI7EO/SLES, 1.3:1:1.15 | 1 | 52.5 |
| K | LAS/NI7EO/CAPB, 1.3:1:1.15 | 1 | 54.4 |
| L | LAS/NI7EO, 8:7 | 2 | 38.6 |
| 8 | LAS/NI7EO/TO20, 1.3:1:1.15 | 2 | 55.0 |

-continued

| | Surfactant system | Total surfactant | CSM value |
|---|---|---|---|
| M | LAS/NT7EO/SLES, 1.3:1:1.15 | 2 | 49.7 |
| N | LAS/NI7EO/CAPB, 1.3:1:1.15 | 2 | 42.7 |

Example 9, Comparative Example P

Laundry Detergent Powder Formulations

High bulk density non-enzymatic laundry detergent powders were prepared to the formulations given below.

| Ingredient | P | 9 |
|---|---|---|
| Base powder | | |
| Linear alkylbenzene sulphonate | 8.90 | 8.84 |
| Nonionic surfactant $C_{12}$—$C_{15}$ 7EO | 6.95 | 6.91 |
| Soap | 1.72 | 1.71 |
| Acrylic/maleic copolymer | 1.22 | 1.20 |
| Zeolite MAP | 21.01 | 20.89 |
| Sodium carbonate (light) | 13.71 | 13.60 |
| Sodium sulphate | 11.30 | 11.14 |
| Sodium silicate | 1.17 | 1.15 |
| Moisture, salts etc | 5.38 | 5.34 |
| Total base powder | 71.36 | 70.77 |
| Postdosed | | |
| Antifoam granule | 1.30 | 1.30 |
| Fluorescer granule | 0.85 | 0.85 |
| Sodium carbonate (dense) | 3.61 | 2.10 |
| Citric acid | 2.56 | 2.56 |
| Na carbonate/silicate granules | 3.15 | 3.15 |
| Nonionic surfactant $C_{16}$—$C_{18}$ 25EO | — | 2.10 |
| TAED* granules (83%) | 2.75 | 2.75 |
| Sodium percarbonate | 13.20 | 13.20 |
| EDTMP**, EHDP*** | 1.10 | 1.10 |
| Perfume | 0.12 | 0.12 |
| Total | 100.00 | 100.00 |

**tetraacetyl ethylenediamine
***ethylenediamine pentamethylene phosphonate, Ca/Na salt
****1-hydroxyethane-1, 1-diphosphonate, Na salt A typical wash liquor based on the formulation of Example 9 (prepared by dissolving 115 g of formulation in 14.5 litres of water) is significantly milder than one based on the formulation of Comparative Example P.

We claim:

1. A built particulate laundry detergent composition comprising (i) from 5 to 25 wt % of an anionic sulphonate or sulphate surfactant, (ii) from 1 to 10 wt % of an ethoxylated alcohol nonionic surfactant having an alkyl chain length of from $C_8$ to $C_{18}$ and an average degree of ethoxylation of from 3 to 10.

(iii) from 1 to 5 wt % of a highly ethoxylated alcohol nonionic surfactant having an average degree of ethoxylation of from 15 to 40, and having a branched alkyl chain length of from $C_{12}$ to $C_{20}$ containing at least 3 methyl groups, (iv) from 10 to 80 wt % of detergency builder and (v) optionally other detergent ingredients to 100 wt %.

2. A detergent composition as claimed in claim 1, wherein the highly ethoxylated nonionic surfactant (iii) has an average degree of ethoxylation of from 16 to 35.

3. A detergent composition as claimed in claim 2, wherein the highly ethoxylated nonionic surfactant (iii) has an average degree of ethoxylation of from 20 to 30.

4. A detergent composition as claimed in claim 1, wherein the highly ethoxylated nonionic surfactant (iii) has an alkyl chain length of from $C_{16}$ to $C_{18}$.

5. A detergent composition as claimed in claim 1, wherein the highly ethoxylated alcohol nonionic surfactant (iii) is present in an amount of from 2 to 3 wt %.

6. A detergent composition as claimed in claim 1, wherein the highly ethoxylated alcohol nonionic surfactant (iii) is present in the form of separately admixed granules.

7. A detergent composition as claimed in claim 6, wherein the granules have a purity of 100 wt % and a particle size within the range of from 100 to 1000 micrometers.

8. A detergent composition as claimed in claim 1, which is free of enzymes.

9. Method for increasing the mildness to the skin of a built particulate laundry detergent composition, comprising contacting the skin with a built particulate laundry detergent composition comprising (i) from 5 to 25 wt % of an anionic sulphonate or sulphate surfactant, (ii) from 1 to 10 wt % of an ethoxylated alcohol nonionic surfactant having an alkyl chain length of from $C_8$ to $C_{18}$ and an average degree of ethoxylation of from 3 to 10.

(iii) from 1 to 5 wt % of a highly ethoxylated alcohol nonionic surfactant having an average degree of ethoxylation of from 15 to 40, and having a branched alkyl chain length of from $C_{12}$ to $C_{20}$ containing at least 3 methyl groups, (iv) from 10 to 80 wt % of detergency builder and (v) optionally other detergent ingredients to 100 wt %.

10. Method as claimed in claim 9, wherein the highly ethoxylated alcohol nonionic surfactant has an average degree of ethoxylation of from 20 to 30.

11. Method as claimed in claim 9, wherein the highly ethoxylated alcohol nonionic surfactant has an alkyl chain length of from $C_{12}$ to $C_{20}$.

12. Method as claimed in claim 11, wherein the highly ethoxylated alcohol nonionic surfactant has an alkyl chain length of from $C_{16}$ to $C_{18}$.

* * * * *